US006381856B2

(12) United States Patent
Lüttgens

(10) Patent No.: US 6,381,856 B2
(45) Date of Patent: May 7, 2002

(54) HAND-HELD SHARPENER AS A CONTAINER-TYPE SHARPENER

(75) Inventor: Fritz Lüttgens, Erlangen (DE)

(73) Assignee: Kum Limited, Dublin (IR)

( * ) Notice: Subject to any disclaimer, the term of this patent is extended or adjusted under 35 U.S.C. 154(b) by 0 days.

(21) Appl. No.: 09/771,390

(22) Filed: Jan. 26, 2001

(30) Foreign Application Priority Data

Jan. 26, 2000 (DE) ..... 100 03 233

(51) Int. Cl.[7] ..... B43L 23/00
(52) U.S. Cl. ..... 30/454; 30/457; 144/28.11
(58) Field of Search ..... 30/451, 453, 454, 30/457, 461; 144/28.1, 28.11, 28.5

(56) References Cited

FOREIGN PATENT DOCUMENTS

| | | |
|---|---|---|
| DE | 623 105 | 11/1957 |
| DE | 1 800 222 | 3/1970 |
| DE | 27 34 695 C2 | 9/1982 |
| DE | 38 15 746 A1 | 11/1989 |
| DE | 299 09 978 U1 | 12/1999 |
| GB | 2 270 039 A | 3/1994 |

*Primary Examiner*—Hwei-Siu Payer
(74) *Attorney, Agent, or Firm*—Herbert L. Lerner; Laurence A. Greenberg; Werner H. Stemer

(57) ABSTRACT

A container-type sharpener is provided with a generator that can be manually operated or set off and provides an acoustic or visual effect. For this purpose, a shavings-collecting container is configured to be compressible against a flexible restoring pressure and the effect generator is pressure-operated or pressure-controlled.

13 Claims, 2 Drawing Sheets

HAND-HELD SHARPENER AS A CONTAINER-TYPE SHARPENER

BACKGROUND OF THE INVENTION

FIELD OF THE INVENTION

The invention relates to a hand-held sharpener for encased or unencased pencil cores. Pencil cores of this type generally serve for writing, drawing or the like. A functionally related feature is that, when they are used as intended, the cores are worn down by permanent abrasion. As a result, the shape of the tip of the core changes. It becomes blunt and this requires that the tip or shape of the core, which was originally pointed but has been blunted by use, is restored at relatively short time intervals by a sharpening operation. Hand-held sharpeners of a simple configuration are essentially used for this purpose. In their basic form, such hand-held sharpeners are very much mass-produced articles.

Sharpening waste produced during sharpening, includes powdered and sometimes also pasty core material and also shavings of encasing material, usually consisting of wood, gives rise to a soiling problem. Therefore, in the case of simple hand-held sharpeners, the sharpening is carried out over a waste container receiving the sharpening and shaving waste. Further developments of hand-held sharpeners of this type relate to a shavings-collecting container being directly connected to the hand-held sharpener, in other words is combined with it. Hand-held sharpeners of this type are referred to as container-type sharpeners. In the case of container-type sharpeners, the functional part accomplishing the actual sharpening operation is usually fixed to an inner side of a closure cap of the container intended for receiving the sharpening waste. A sharpening channel of the hand-held sharpener in this case passes through the closure cap of the container. The sharpening operation takes place with the collecting container closed by the closure cap. To prevent sharpening waste from coming out through the sharpening channel once the sharpening operation has been completed and the pencil has been removed from the sharpening channel, it is further known in the case of container-type sharpeners to close the sharpening channel with a closure plug and also to apply the closure plug captively outside its closing position. Such a sharpener is disclosed in German Patent DE 27 34 695 C2.

Furthermore, it is known in the case of container-type sharpeners to support the functional part accomplishing the sharpening operation, to be specific the actual sharpener, flexibly within the container against the sharpening pressure, and for this purpose to configure the container resiliently in an axial direction, see German Patent DE 1 800 222 C2.

To simplify the description of the invention, the sharpened object is referred to hereafter as a "pencil" for short. This is to be understood quite generally as being an encased or unencased pencil core not only for writing purposes but also for drawing purposes or cosmetic purposes. Because of the frequent necessity for a pencil of this type to be sharpened, the user is repeatedly looking for the sharpener, which as experience shows is easily misplaced and therefore not always immediately to hand.

SUMMARY OF THE INVENTION

It is accordingly an object of the invention to provide a hand-held sharpener as a container-type sharpener which overcomes the above-mentioned disadvantages of the prior art devices of this general type, which, in addition to its sharpening purpose, it can offer other useful functions, including entertainment. This makes it easier to find the often misplaced sharpener. Extending the functional purpose of the sharpener also encourages children in particular to keep restoring the pencil to its functionally optimum form, i.e. to sharpen it, and in this way counter the practice of thoughtlessly putting it aside with a blunted tip. The sharpener is also to be configured in such a way that, in addition to the functional regeneration of the tip of the core, using it by hand is found to be entertaining. The fundamental intention of the invention is to turn a hand-held sharpener configured as a container-type sharpener into a multi-functional part, and in this way to enhance its useful value.

With the foregoing and other objects in view there is provided, in accordance with the invention, a hand-held, container-type sharpener for encased and unencased pencil cores. The sharpener includes a shavings-collecting container which is compressible with regard to a volume received, and an effect generator operated/triggered by hand and providing an acoustic effect or a visual effect. The effect generator is at least partially disposed in the shavings-collecting container and is operated or controlled by a compressive pressure exerted on the shavings-collecting container.

The object is achieved by a hand-held sharpener that contains a generator, in particular a generator which can be operated by hand, for an additional effect and in which the shavings-collecting container can be manually changed with regard to its volume. The collecting container is advantageously configured in such a way that it can be compressed against a flexible restoring pressure, with the result that the effect generator can be manually operated or controlled by pressure directly in a simple way. This solution can be realized with a relatively low technical outlay, which helps to achieve the property of the hand-held sharpener as a cheap mass-produced article.

The effect generator may be an electronic module or contain an electronic module that has piezoelectric properties. Its effect is then brought about by the hand-held sharpener simply pushing against it, the sharpener being movably guided with respect to the effect generator on account of the way in which the outline shape of the shavings-collecting container can be manually changed, in particular on account of the way in which it can be compressed and flexibly restored.

The effect generator may also be controlled by positive atmospheric pressure, which is produced by manual compression of the shavings-collecting container. As this happens, the pencil inserted in the pencil-guiding channel of the sharpener body supports the atmospheric pressure build-up during the compression of the shavings-collecting container as a closure plug. However, in keeping with its configuration as a multi-functional part, the sharpener according to the invention is not dependent on the sharpening channel of the hand-held sharpener being closed in an essentially pressure-tight manner. The closure effect with the pencil removed can also be achieved simply by the operating hand, in particular by the tip of a finger. This operating hand can then accomplish the compression of the container.

It is particularly simple and cost-effective if a simple wind-instrument module is used as the effect generator. The effect generator may, however, also be a wind-power module, which generates the power for producing the effect electrically. The effect may be of a visual or acoustic nature or else act in some other way.

In accordance with an added feature of the invention, the shavings-collecting container is compressible and after being compressed the shavings-collecting container provides a flexible restoring pressure.

In accordance with an additional feature of the invention, the effect generator is an electrical module.

In accordance with another feature of the invention, the effect generator is one of operated and controlled by positive atmospheric pressure in the shavings-collecting container.

In accordance with a further feature of the invention, a sharpener is disposed in the shavings-collecting container. The sharpener has a pencil-core insertion channel formed therein and a closure plug is provided for closing off the pencil-core insertion channel of the sharpener.

In accordance with another added feature of the invention, the effect generator is an acoustic effect generator and has a wind-instrument module.

In accordance with another additional feature of the invention, the effect generator has a wind-power module being a power generator for electrically producing an effect.

In accordance with further feature of the invention, the shavings-collecting container has a wall and the effect a generator is fixed on the wall.

In accordance with a further added feature of the invention, the shavings-collecting container has an interior space formed therein, and the effect generator passes through the wall of the shavings-collecting container and forms an air passage acting from the interior space inside the shavings-collecting container to an outside atmosphere.

In accordance with a further additional feature of the invention, the effect generator has the air passage formed therein leading from outside of the shavings-collecting container to the interior space inside of the shavings-collecting container.

In accordance with yet another feature of the invention, the effect generator has a particle filter disposed in the air passage.

In accordance with yet another further feature of the invention, the shavings-collecting container is manually compressible against a flexible restoring pressure.

In accordance with a concomitant feature of the invention, the electrical module has piezoelectric properties.

Other features which are considered as characteristic for the invention are set forth in the appended claims.

Although the invention is illustrated and described herein as embodied in a hand-held sharpener as a container-type sharpener, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
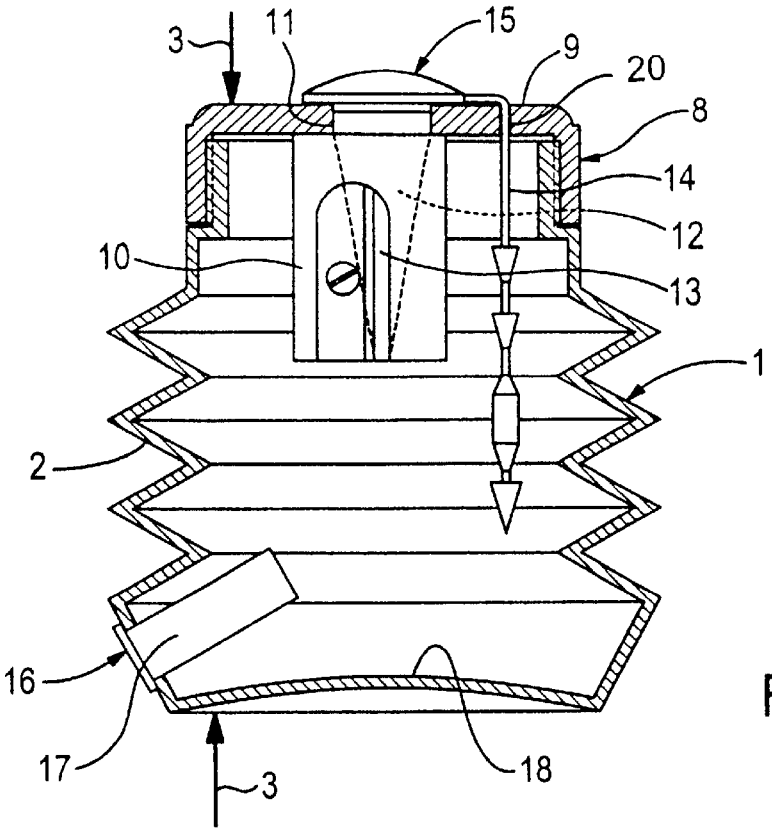
FIG. 1 is a diagrammatic, sectional view of a hand-held sharpener configured as a container-type sharpener with a wind-instrument module as an acoustic effect generator according to the invention.

In all the figures of the drawing, sub-features and integral parts that correspond to one another bear the same reference symbol in each case. Referring now to the figures of the drawing in detail and first, particularly, to FIGS. 1 and 3 thereof, there is shown a container 1 that has the form of a bellows membrane and is made from a soft plastic. It is thus intrinsically flexible and so readily resilient that it flexibly yields, in particular under compressive pressure acting in a direction of arrows 3. The container 1 is one with the features and properties of a container according to FIG. 1 of German Patent DE 1 800 222 C2.

Figure 2:
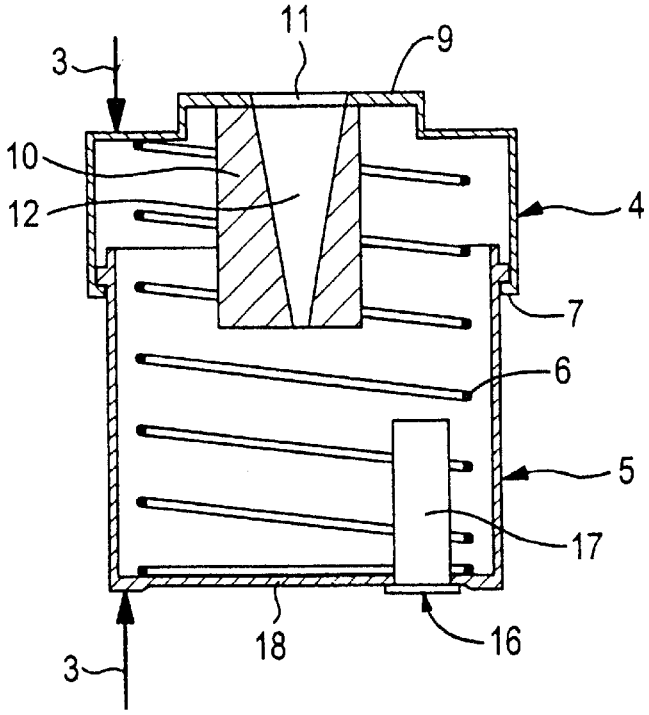
FIG. 2 is a sectional view of a second embodiment of the hand-held sharpener being functionally similar to that shown in FIG. 1, modified with regard to the configuration of the container.
Figure 4:
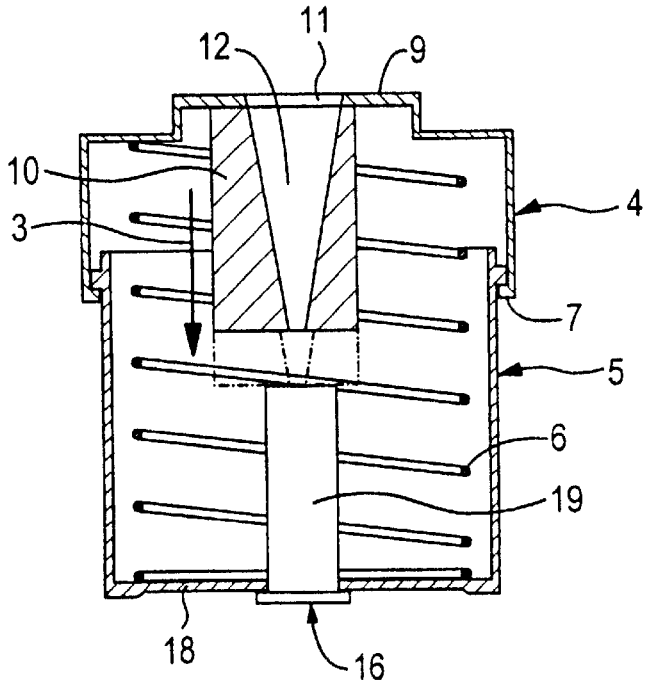
FIG. 4 is a sectional view of a fourth embodiment of the hand-held sharpener analogous to FIG. 3 with, however, a modified structural form of the container.

In the embodiments according to FIGS. 2 and 4, a cap 4 of a container 5 has the form of a pot that can be slid telescopically on the container 5. Here, the container 5 is formed of an inflexible material. Inserted in it is a compliant compression spring 6, which is supported against the cap 4. A clamping device 7 of any desired type prevents the cap 4 from being lifted off the container 5 by the spring 6. To this extent, the configuration of the container corresponds to the embodiment according to FIG. 2 of German Patent DE 1 800 222 C2.

In FIGS. 1–4, the container 1 is closed by a screw cap 8 or a sliding cap 4. Both caps 4, 8 bear on an inner side of a top closure surface 9 on a housing 10 of a hand-held sharpener in a configuration that is commercially available and commonplace as a mass-produced article. The top closure surface 9 of the cap 4 or 8 is penetrated by an opening 11, which is in line with a conical pencil guiding channel 12 of the sharpener housing 10. A paring cutter 13 of the sharpener acts at the circumference of the pencil guiding channel 12.

The top closure surface 9 of the screw cap 8 is penetrated not only by the opening 11 for the passing through of the pencil but also by a guide opening 20 for a fixing filament 14 of a closure plug 15, as is known in principle from German Patent DE 27 34 695 C2.

Fixed on a container wall above a container base 18 is an effect generator 16 (FIG. 1). The effect generator 16 passes through the wall of a shavings-collecting container 2 of the container 1 and forms an air passage acting from the space inside the container to the outside atmosphere. The air passage, however, shuts off access from the outside to the inside. The effect generator 16 in FIG. 1 is a wind-instrument module 17, an acoustic effectiveness of which is produced directly by positive atmospheric pressure occurring in the container 1.

Instead of the wind-instrument module 17, a wind-powered module may also be present in the same way, as a power generator indirectly producing an electrical effect. The electrical effect generator may then also be positioned at a different location (not represented) from the wind-power module.

Figure 3:
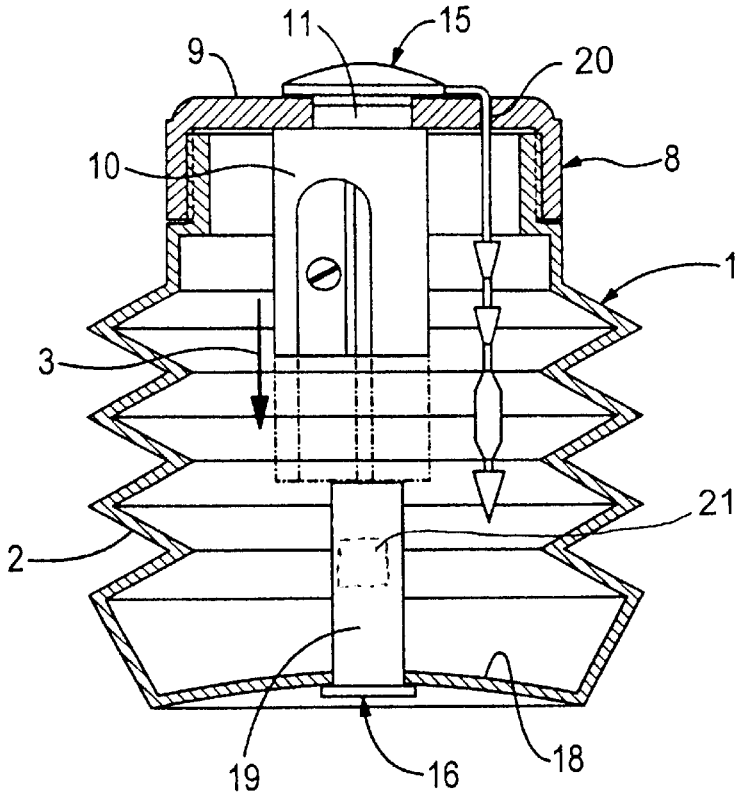
FIG. 3 is a sectional view of a third embodiment aof the hand-held sharpener analogous to FIG. 1 with an electrical module with piezoelectric properties as the effect generator.

In FIG. 3, an electrical module 19 provided with piezoelectric properties passes through the container base 18. It extends into a path of displacement of the sharpener housing 10 and has the housing of the sharpener 10 pushing against it when there is compression of the container 1 produced by the pressure application 3 on the part of the closure cap 4 or 8 (dash-dotted representations of the sharpener housing 10 in FIGS. 3 and 4).

If the effect generator 16 has an air passage, this is provided with a particle filter 21 to prevent sharpening waste from passing through.

For generating an effect using positive atmospheric pressure, the opening 11 in the cap 4 or 8 is closed either by the inserted pencil, by the closure plug 15 or by a hand or finger being placed on by the operating hand and the container 1 is compressed or pushed in the direction of the compressive pressure 3. The positive atmospheric pressure has the effect that the effect generator 16 is pushed against, or put into operation, either directly or indirectly. It generates a noise or a visual signal. As it does so, the positive pressure within the container 1 or 5 can escape directly through the effect generator 16.

In the embodiment according to FIGS. 3 and 4, the effect generator 16 is the electrical module 19, which applies pressure directly to the sharpener housing 10 and the effect generator 16 at the end of the displacement movement in the direction of the compressive pressure 3. Here, the effect generator 16 is the electrical module 19 with the piezoelectric properties.

I claim:

1. A hand-held, container-type sharpener for encased and unencased pencil cores, comprising:

a shavings-collecting container being compressible with regard to a volume received; and an effect generator operated/triggered by hand and providing one of an acoustic effect and a visual effect, said effect generator at least partially disposed in said shavings-collecting container and being one of operated and controlled by a compressive pressure exerted on said shavings-collecting container.

2. The hand-held sharpener according to claim 1, wherein said shavings-collecting container is compressible and after being compressed said shavings-collecting container provides a flexible restoring pressure.

3. The hand-held sharpener according to claim 1, wherein said effect generator is an electrical module.

4. The hand-held sharpener according to claim 3, wherein said electrical module has piezoelectric properties.

5. The hand-held sharpener according to claim 1, wherein said effect generator is one of operated and controlled by positive atmospheric pressure in said shavings-collecting container.

6. The hand-held sharpener according to claim 1, including:

a cutter disposed in said shavings-collecting container, said cutter having a pencil-core insertion channel formed therein; and a closure plug closing off said pencil-core insertion channel of said cutter.

7. The hand-held sharpener according to claim 1, wherein said effect generator is an acoustic effect generator and has a wind-instrument module.

8. The hand-held sharpener according to claim 1, wherein said effect generator has a wind-power module being a power generator for electrically producing an effect.

9. The hand-held sharpener according to claim 1, wherein said shavings-collecting container has a wall and said effect generator is fixed on said wall.

10. The hand-held sharpener according to claim 8, wherein said shavings-collecting container has an interior space formed therein, and said effect generator passes through said wall of said shavings-collecting container and forms an air passage acting from said interior space inside said shavings-collecting container to an outside atmosphere.

11. The hand-held sharpener according to claim 9, wherein said effect generator has said air passage formed therein leading from outside of said shavings-collecting container to said interior space inside of said shavings-collecting container.

12. The hand-held sharpener according to claim 9, wherein said effect generator has a particle filter disposed in said air passage.

13. The hand-held sharpener according to claim 1, wherein said shavings-collecting container is manually compressible against a flexible restoring pressure.

* * * * *